US006422037B1

(12) United States Patent
Benderly

(10) Patent No.: US 6,422,037 B1
(45) Date of Patent: Jul. 23, 2002

(54) DECORATIVE ARTICLE WITH ENGRAVED HIGH CONTRAST IMAGE

(75) Inventor: David Benderly, New York, NY (US)

(73) Assignee: Photoscribe, Inc., New York, NY (US)

( * ) Notice: Subject to any disclaimer, the term of this patent is extended or adjusted under 35 U.S.C. 154(b) by 0 days.

(21) Appl. No.: 09/481,667

(22) Filed: Jan. 12, 2000

(51) Int. Cl.[7] ..... A44C 25/00
(52) U.S. Cl. ..... 63/23; 63/13; 63/24; 40/27.5
(58) Field of Search ..... 219/121.4; 63/13, 63/23, 34; 29/896.4, 896.41, 896.412, 896.42

(56) References Cited

U.S. PATENT DOCUMENTS 4,869,940 A * 9/1989 Shoshani ..... 428/138
5,143,578 A * 9/1992 Luthi ..... 156/272.8
5,215,864 A * 6/1993 Laakmann ..... 148/244
5,554,335 A * 9/1996 Fields et al. ..... 219/121.66
5,609,043 A * 3/1997 Benderly ..... 40/27.5
5,632,916 A * 5/1997 Lappalainen et al. .. 219/121.85
5,799,511 A * 9/1998 Benderly ..... 40/27.5
5,851,335 A * 12/1998 Budnik et al. ..... 156/257
5,979,942 A * 11/1999 Ivicic ..... 281/29
6,231,196 B1 * 5/2001 Mahachek ..... 359/15

* cited by examiner

*Primary Examiner*—Anthony Knight
*Assistant Examiner*—André L. Jackson
(74) *Attorney, Agent, or Firm*—Kirschstein, et al.

(57) ABSTRACT

An article of jewelry includes a precious metal substrate carrying an image, especially a laser-engraved relief, consisting of a plurality of pits. An ash residue at least partially fills the pits. A sealing element secures the residue in the pits. The residue has a darker color than that of the substrate to improve the clarity and contrast of the image visible through the element. The substrate is mounted on an annular support element constructed as a split ring having a gap, and there is provided a mechanism for controlling the size of such gap to tighten the support element around the substrate.

15 Claims, 1 Drawing Sheet

DECORATIVE ARTICLE WITH ENGRAVED HIGH CONTRAST IMAGE

BACKGROUND OF THE INVENTION

1. Field of the Invention

The present invention relates to ornamental articles in general, and more particularly to articles of jewelry and methods of making the same with laser-engraved, high contrast images.

2. Description of the Related Art

There are already known various constructions of jewelry articles, such as pendants, rings, earrings, charms or the like, among them such which incorporate real precious metal, especially gold, coins. While jewelry of this type has a high degree of aesthetic appeal to many individuals, both would-be owners and mere observers, it is well beyond the means of many of them. While this limited affordability of such items may contribute to their overall appeal, there are still many people who would be willing to pay more for a genuine jewelry article containing real gold or other precious metal rather than a cheap imitation, if only it was not that prohibitively expensive.

The advent of laser technology has created diverse possibilities in many fields of human endeavor in that it made it possible to produce various rather intricate products at a relatively low cost by, among other things, using laser rays to produce a variety of patterns on a substrate or in a layer that coats a substrate by causing the material of such layer or such substrate to evaporate to the requisite depth from selected regions and not from others. Examples of arrangements and methods using this approach can be found, for instance, in the following U.S. Pat. No. 3,588,439 to Heller, et al.; U.S. Pat. No. 3,665,483 to Becker, et al.; U.S. Pat. No. 3,832,948 to Barker; U.S. Pat. No. 4,081,653 to Koo, et al.; U.S. Pat. No. 4,156,124 to Macken, et al.; U.S. Pat. No. 4,480,169 to Macken; and U.S. Pat. No. 5,235,154 to Economicos.

As advantageous as the expedients disclosed in these patents may be for the purposes for which they have been developed, they would have only a limited, if any, applicability in the jewelry field, and then only with substantial modifications. Thus, since most if not all of these patents deal with metal-coated substrates, they could have some applicability to, say, costume or gold-plated jewelry, a field that is separate and distinct from and totally unrelated, beyond surface resemblance, to the real precious metal jewelry field. In any event, none of these patents contains any suggestions how their approaches could be applied in the manufacture of real, rather than metal-coated, jewelry.

In my earlier U.S. Pat. Nos. 5,609,043 and 5,799,511, disclosed real jewelry articles and methods of making them with engraved images by directing a laser through a transparent protective element that overlay a precious metal substrate, such as a gold foil or thin disk. The power output of the laser was maintained low enough to prevent the laser from burning holes in the substrate to be engraved, thereby detracting from the aesthetic appeal of the engraved pattern. The laser output power also needed to be kept low to prevent the formation of a latent image on the protective element itself. This latent image tended to blur the visibility of the pattern engraved into the substrate.

OBJECTS OF THE INVENTION

Accordingly, it is a general object of the present invention to advance the state of the prior art.

More particularly, it is an object of the present invention to provide a decorative article, especially real jewelry that does not possess the drawbacks of the known jewelry articles of this type.

Still another object of the present invention is to devise a jewelry article of the type here under consideration that not only can be rightfully called a real jewelry article but also does it at a cost amounting to only a fraction of its traditional counterparts.

It is yet another object of the present invention to design the above article of jewelry in such a manner as to be virtually visually indistinguishable from its traditional counterparts unless scrutinized up close.

Another object of the present invention is to improve the contrast and clarity of a laser-engraved image formed on the jewelry article.

A concomitant object of the present invention is so to construct the jewelry article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an article of jewelry comprising a precious metal substrate having a pattern of pits burned in a major surface of the substrate to define an engraved image, an ash residue in the pits and having a color contrasting with that of the substrate, and an optically clear sealing element for sealing the ash residue in the pits to improve the contrast and the clarity of the engraved image visible through the sealing element.

A particular advantage of the jewelry article as described so far is that the substrate is an actual thin gold disk (as opposed to merely a very thin gold-plated layer) and can be rightfully considered real jewelry. Yet, because of the relatively low amount of gold or other precious metal contained in the disk, the cost of the article is a mere fraction of its traditional thicker counterpart, i.e. a gold coin modified to form a piece of jewelry, such as a pendant.

According to an advantageous aspect of the present invention, the substrate is supported by a frame or an annular support having respective inner and outer peripheries. The support may have a circumferentially extending continuous groove on the inner periphery thereof and into which the substrate is partially received. The annular support element is constructed as a split ring having respective spaced end portions defining a gap therebetween. Then, there is further provided means for controlling the size of such gap with attendant tightening of the support element around the substrate, such controlling means including respective projections on the end portions of the support element, one having a through opening and the other a threaded bore, and a screw-like tightening element passing through the through bore and threaded into the threaded bore and having an enlarged head portion engaging the one projection next to the through bore thereof.

It is particularly advantageous when the aforementioned image is a laser-engraved relief on the major surface of the substrate. The relief is formed by directing a laser directly at the surface. The energy density of the laser on the substrate is adjusted to a power level sufficient to scorch, but not burn through the substrate. The ash residue is concomitantly produced from incinerated portions of the substrate. The residue is a grayish-white to black powder that at least partially fills the pits. This darker residue contrasts with the lighter color of the substrate. When the substrate is a gold disk having a yellowish color, the darker residue accentuates the image.

In accordance with this invention, the major surface of the substrate is cleaned, but the ash residue is left intact within the pits. Then, the sealing element may be applied as a coating over the image. The sealing element may be applied in a liquid, paste, or aerosol manner. The sealing element is transparent to visible light and is preferably cured by ultraviolet light, or by a combination of air, heat or time factors. The sealing element may also be a transparent disc made of either glass or plastic. The contrast and the clarity of the engraved relief visible through the sealing element is much improved over the known art.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
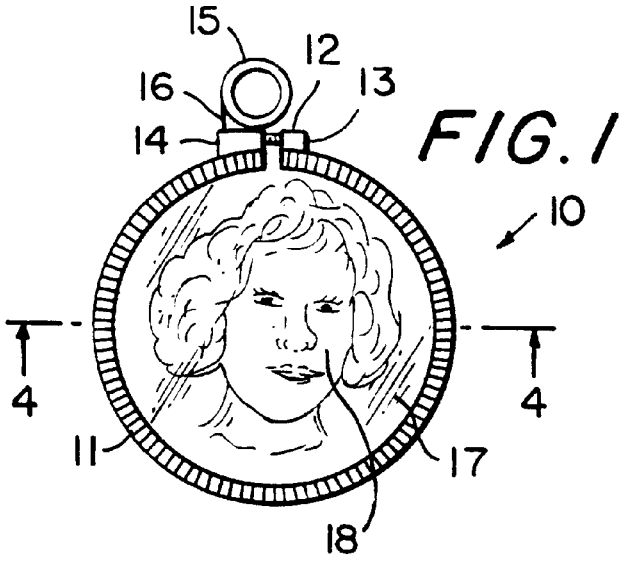
FIG. 1 is a top elevational view of a jewelry article embodying the present invention.

Referring now to the drawing in detail, and first to FIG. 1 thereof, it may be seen that the reference numeral 10 has been used therein to identify a first embodiment of a jewelry article embodying the present invention in its entirety. As shown, the jewelry article 10 includes, as one of its optional components, an annular support element or frame 11 that is constructed as a split ring in that it is circumferentially incomplete, having two end portions that are spaced a certain, albeit a rather small, distance or gap apart.

A first projection 12, which may advantageously have a substantially cylindrical configuration, is integrally provided on one of such end portions. The projection 12 has a substantially smooth hole therethrough through which a screw 13 having an enlarged head passes on its way toward a second projection 14 of a configuration similar to that of the projection 12. The projection 14 which, like the projection 12, is of one piece with or securely permanently connected to the split-ring support element 11, but this time to its other end portion across the gap from the first projection 12, is provided with an internally threaded hole into which the externally threaded shank of the screw 13 is threaded.

For reasons that will become apparent as the present description proceeds, it is desired to make the existence of the aforementioned gap in the annular support element 11 and of the associated ring tightening mechanism 12 to 14 as inconspicuous as possible. For this reason, the mechanism 12 to 14 is disguised as nothing more than a protuberance on the outer periphery of the jewelry article 10 serving the purpose of connecting an eyelet 15 to the jewelry article 10 in cooperation with an upstanding web 16, as is usual when a jewelry piece is to be worn as a pendant suspended from a chain wound around the neck, the wrist, or another part of the body of the user.

Figure 4:
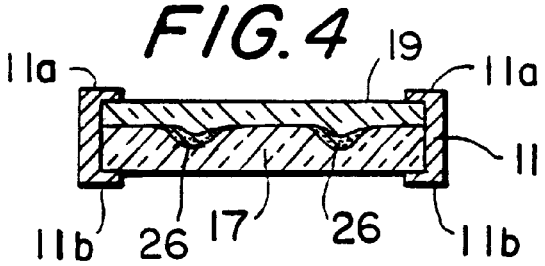
FIG. 4 is a cross-sectional view on a smaller scale taken on line 4—4 of FIG. 1.

It will be appreciated that tightening of the screw 13 will result in a reduction in the size of the aforementioned gap and thus the tightening of the annular support element 11 around whatever may be present in the space surrounded by it. As a comparison of FIGS. 1 and 4 with one another will reveal, what the split-ring support element is tightened around is a circular substrate 17 carrying at least one image 18 on at least one of its major surfaces.

According to one embodiment of the present invention, the substrate 17 is constituted by a very thin self-supporting disk, approximately 4 mils thick, of precious metal, such as gold, silver or platinum. Such thin disks are rather inexpensive in view of the relatively small amount of the precious metal they contain; yet, when properly mounted in a frame and embellished by the respective image 18, they can be made virtually indistinguishable from much thicker and hence considerably more expensive articles, such as gold or silver coins. And this is where the present invention comes in: to give the article 10 the appearance of an expensive piece of jewelry, such as a pendant, incorporating a precious metal coin, without incurring the expense of using an actual coin.

Figure 2:
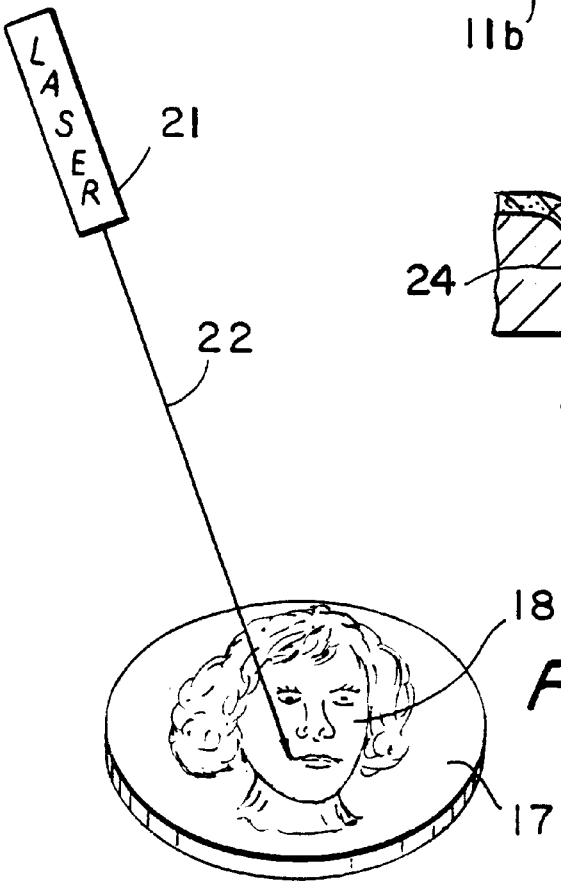
FIG. 2 is a diagrammatic view indicating a step in the production of the article.

The image 18 is advantageously provided on the substrate 17 in a manner indicated in FIG. 2 of the drawing. As shown there, it is produced by laser ablation or engraving, in that a laser beam 22 issued by a laser 21 is controlled in such a manner as to scorch the metal material from selected regions of the respective major surface of the substrate 17 while leaving other regions intact.

More specifically, a fundamental or a harmonic frequency of an NdYAG or YLF laser is preferably used to generate the laser beam at a certain power level. The level must not be too high to avoid burning entirely through the substrate 17, but not too low to enable the engraving to proceed. The laser beam has an output power level or energy density at the substrate which is sufficient to scorch the major surface thereof and form a pattern of pits 24 or craters which is arranged to define the image 18. When the laser beam directly strikes the major surface, the area of contact vaporizes to form a depression or cavity. The depth of the cavity may amount to just a few angstroms or micrometers. The laser beam may be pulsed so that a plurality of pulses are needed to form the cavity.

The area of incidence of the laser beam on the substrate is a spot of light. Relative movement between the laser beam and the substrate causes the spot to move. The image may be formed of a multitude of discrete spots spaced apart from one another in a manner resembling the formation of characters or images from a dot matrix printer, or successive spots may partially overlie one another to form continuous elongated lines or channels. Preferably, the beam is steered by movable mirrors under computer control.

Figure 3:
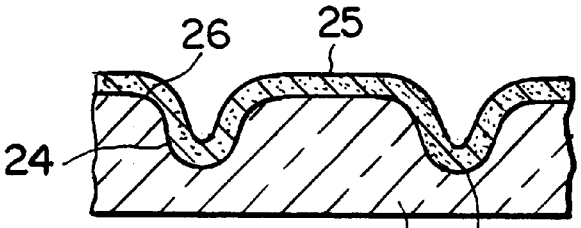
FIG. 3 is a broken-away cross-sectional view on an enlarged scale of the article of FIG. 1 during its production.

During cavity formation, an ash residue 26 is concomitantly produced. The ash residue is a grayish-white to black powder constituting vaporized portions of the substrate. Most of the residue lines the cavities, but some of the residue scatters in all directions and coats at least part of the major surface of the substrate 17 in regions 25 away from the image 18, as depicted in FIG. 3.

In further accordance with this invention, the residue-coated regions 25 on the major surface of the substrate are cleaned to remove the residue in all areas except where the residue is contained in the pits defining the image. The major surface may be brushed, or wiped, or treated with a solvent to assist such removal. At the end of the cleaning process, the image 18 is outlined and accentuated by the residue in the pits. The darker color of the residue contrasts markedly against the lighter colored major surface of the substrate.

In accordance with another feature of this invention, an optically clear sealing element 19 is applied over the residue-filled pits in the substrate. The sealing element 19 may be a curable agent applied in the form of a liquid, paste or spray and cures, preferably by exposure to ultraviolet light. Air, heat or time curing can also be used.

The agent 19 fills in the pits and preferably overlies the cleaned regions 25 of the substrate. The cured agent also serves to physically bond the residue in the pits to prevent removal of the residue. Also, the cured agent protects and waterproofs the exterior surface of the substrate, which is of special benefit during swimming and showering activities. The darkened image is thus uniformly clear to visible light and provides a clear, high contrast image of the etched pattern through the agent.

Alternately, the sealing element 19 can be a transparent glass or plastic member overlying the residue-filled pits in the substrate. The transparent member acts as a physical barrier to prevent removal of the residue from the pits. The transparent member would then advantageously be secured in place by the frame.

To further enhance the resemblance of a real coin, the annular support element 11 may further be provided on its outer periphery with a series of alternating ridges and grooves like those found on many actual coins. This expedient is so well known that it has not been illustrated in the drawing in order not to unduly encumber the same. Of course, the jewelry article 10 will not fool anybody on close observation; it could not be passed on for value as the "real McCoy". However, when worn in the intended manner, it gives the impression reminiscent of a much more expensive jewelry piece and, because it contains actual precious value, even its intrinsic value is more than just nominal.

It will be understood that each of the elements described above, or two or more together, may also find a useful application in other types of constructions differing from the type described above.

For example, the article need not have a circular coin shape as shown, but could have other non-circular configurations. The article need not be a pendant. For example, the high contrast, residue-filled, engraved image can be formed on existing jewelry such as a gold casing of a watch or, for that matter, can be inscribed on any precious metal.

While the present invention has been described and illustrated herein as embodied in a specific constructions of an article of jewelry, it is not limited to the details of this particular construction, since various modifications and structural changes may be made without departing from the spirit of the present invention.

Thus, any decorative article on which an engraved image is to be displayed is contemplated by this invention. Such articles include, for example, pens, cosmetic cases, business card holders, etc.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A decorative article comprising:

a) a precious metal substrate having a colored major surface;

b) a pattern of pits burned in the major surface to define an engraved image;

c) an ash residue in the pits and constituted of incinerated material of the substrate and having a color in contrast with the major surface; and d) an optically clear, sealing element for sealing the ash residue in the pits to improve the contrast and clarity of the engraved image visible through the sealing element.

2. A decorative article comprising:

a) a precious metal substrate having a colored major surface;

b) a pattern of pits burned in the major surface to define an engraved image, each pit being a laser-ablated crater from which material of the substrate is removed to form a depression;

c) an ash residue in the pits and having a color in contrast with the major surface; and d) an optically clear, sealing element for sealing the ash residue in the pits to improve the contrast and clarity of the engraved image visible through the sealing element.

3. The decorative article as defined in claim 2; and further comprising a frame for supporting the substrate, said frame constituting an annular support element constructed as a split ring having respective spaced end portions defining a gap therebetween; and further comprising means for controlling the size of such gap with attendant tightening of said support element around said substrate, including respective projections on said end portions of said support element, one having a through opening and the other a threaded bore, and a screw-like tightening element passing through said through bore and threaded into said threaded bore and having an enlarged head portion engaging said one projection next to said through bore thereof.

4. The decorative article as defined in claim 2; and further comprising a frame for supporting the substrate, said frame constituting an annular support element having respective inner and outer peripheries, and including a circumferentially continuous groove on said inner periphery thereof; and wherein said substrate is partially received in said groove.

5. The decorative article as defined in claim 2, wherein said residue is a dark powder at least partially filling a respective depression.

6. The decorative article as defined in claim 2, wherein said substrate is a self-supporting disk, and wherein said image is a laser-engraved relief in said major surface of said disk.

7. The decorative article as defined in claim 6, wherein said disk is gold.

8. The decorative article as defined in claim 2, wherein said sealing element is constituted of a light-transmissive, synthetic plastic material.

9. The decorative article as defined in claim 8, wherein said sealing element is constituted of an ultraviolet-curable substance coated over the residue in the pits.

10. The decorative article as defined in claim 8, wherein said sealing element is a transparent member overlying the residue in the pits.

11. A method of making a decorative article, comprising the steps of:

a) burning a pattern of pits in a major surface of a precious metal substrate to define an engraved image by directing a laser beam directly at said substrate;

b) at least partially filling the pits with an ash residue of contrasting color with said major surface of said substrate by adjusting laser beam energy density on said substrate to a level sufficient to scorch said substrate and concomitantly produce said ash residue; and c) sealing said ash residue in said pits to improve the contrast and clarity of the engraved image.

12. The method as defined in claim 11; and further comprising the step of cleaning said major surface without removing said ash residue from said pits before said sealing step is performed.

13. The method as defined in claim 11, wherein said sealing step is performed by coating an optically clear layer over said residue in said pits.

14. The method as defined in claim 11, wherein said sealing step is performed by overlaying an optically clear member over said residue in said pits.

15. The method as defined in claim 11, wherein said precious metal substrate is a gold disk.

* * * * *